US006038719A

United States Patent [19]

Castagna

[11] Patent Number: 6,038,719

[45] Date of Patent: Mar. 21, 2000

[54] NOVELTY PILLOW

[76] Inventor: Doris Castagna, 113 Prescott F, Deerfield Beach, Fla. 33442

[21] Appl. No.: 09/258,458

[22] Filed: Feb. 26, 1999

[51] Int. Cl.[7] ..... A47C 20/02

[52] U.S. Cl. ..... 5/636; 5/640; 5/639; D6/601

[58] Field of Search ..... 5/636, 639, 640, 5/642, 643, 644, 490; D6/601

[56] References Cited

U.S. PATENT DOCUMENTS

| | | | |
|---|---|---|---|
| D. 305,711 | 1/1990 | Wood | D6/601 |
| D. 329,351 | 9/1992 | Ezpleta | D6/601 |
| D. 348,168 | 6/1994 | Keller | D6/601 |
| D. 397,901 | 9/1998 | Williams | D6/601 |
| D. 397,902 | 9/1998 | Knorrek | D6/601 |
| 5,027,457 | 7/1991 | Sweet | 5/490 |
| 5,054,143 | 10/1991 | Javavier | 5/636 |
| 5,509,157 | 4/1996 | Story | 5/636 |
| 5,778,468 | 7/1998 | Saarela et al. | 5/639 |

*Primary Examiner*—Alexander Grosz
*Attorney, Agent, or Firm*—Bowen, Lhota & Firtell, P.A.; David P. Lhota, Esq.

[57] ABSTRACT

A novelty pillow comprising a pillow base structure, a front surface and a back surface, at least one slit opening in at least one surface, a cavity recessed in the base structure below the slit, at least one phallic member extendable from the cavity out through the slit and indicia for conveying predetermined messages.

12 Claims, 5 Drawing Sheets

NOVELTY PILLOW

BACKGROUND OF THE INVENTION

1. Field of the Invention

This invention relates generally to a novelty pillow, and more particularly, to a novelty pillow having at least one slit and at least one elongated member, such as a phallic-like member, extending outward from the slit and indicia for conveying a message related to the slit and member.

2. Description of the Background Art

Various types of pillows are known in the art. For instance, there are bed pillows, throw pillows, body pillows, decorative pillows and holiday pillows, to name a few. In fact, numerous patents have issued for various types of pillows. U.S. Pat. Des. 237,569, issued to De Rue, discloses a pillow in the shape of female breasts. U.S. Pat. No. 4,794,657, issued to Avery, discloses a tummy hugger pillow combination comprising trunk, head and leg pillows. U.S. Pat. Des. 391,112, issued to Houston, discloses another pillow design. U.S. Pat. Des. 320,522, issued to Deremiah discloses a combined pillowcase and multiple pillow assembly. U.S. Pat. No. 5,809,594, issued to Isogai, discloses a pillow combination for providing cervical vertebras support. U.S. Pat. Des. 397,901 discloses a pillow displaying a happy face. U.S. Pat. Des. 320,522, issued to Deremiah, discloses a combined pillowcase and multiple pillow assembly. U.S. Pat. No. 5,168,590, issued to O'Sullivan, discloses a therapeutic pillow cover having compartments for receiving hot/cold packs and/or insert supports. U.S. Pat. No. 5,864,904, issued to Rudick, discloses a sectioned bed pillow connected by a fabric tether. U.S. Pat. No. 5,864,903, issued to Newman, discloses a pillow having a storage pocket for storing a condom. Many other patents have issued for various other pillow designs. Despite the number of patents that have issued in this art, none are known which disclose a humorous pillow design having components which resemble a penis.

A pillow design with features that resemble a penis would be welcomed by the novelty items business and those looking for a new, humorous gift to give at bachelor parties, wedding showers or other events. A pillow with a penis member could be creatively designed with indicia for conveying funny messages. Such a pillow would provide a new and welcomed product to the gag-gift industry. As there are no pillows known having these and similar design features, there exist a need for a penis pillow in the gag-gift industry. The instant invention addresses this need by providing a pillow having at least one elongated member and corresponding indicia.

BRIEF SUMMARY OF THE INVENTION

In light of the foregoing, it is an object of the instant invention to provide a novelty pillow that imitates male genitalia for the gag-gift industry.

It is another object of the instant invention to provide a humorous novelty pillow for the gag-gift industry.

It is an additional object of the instant invention to provide a novelty pillow having at least one phallic member that may be concealed and selectively revealed.

It is also an object of the instant invention to provide a novelty pillow that conveys humorous messages related to the structure of the pillow.

It is a further object of the instant invention to provide a novelty pillow that has at least one phallic member that is semi-automatically and/or automatically extended from the pillow and/or revealed outside the pillow.

It is yet another object of the instant invention to provide a novelty pillow that has at least one phallic member that is flexible and soft.

It is yet an additional object of the instant invention to provide a novelty pillow that is semi-rigid or rigid.

It is yet another object of the instant invention to provide a novelty pillow that is safe to use.

It is yet a further object of the instant invention to provide a novelty pillow that is cost effective to manufacture.

In light of these and other objects, the instant invention comprises a pillow having at least one slit/opening, at least one phallic member permanently affixed within the pillow proximal the slit, structure that allows the member to be selectively stored within the pillow and extended outward from the pillow through the slit, and indicia on at least one surface of the pillow related to the member. The slit, or slits, are defined by at least one surface in the pillow and provide access to a defined volume/cavity within the pillow. At least one phallic member is disposed in the cavity. The phallic member is permanently affixed to the pillow within the cavity and the cavity provides sufficient volume for concealing the phallic member therein. The phallic member is selectively extended outside the pillow through the slit by spreading the slit open and extending the member therethrough. The member may be spring loaded such that it pops out when the slit is opened. The instant invention may include a plurality of slits and storage cavities, on either one or more surfaces defined by the pillow. The instant invention may also include at least one substantially spherical, or egg-shape, object permanently affixed within the cavity below the phallic member.

The phallic member is preferably soft and at least partially pliable, comprises fabric and stands erect when removed from the cavity. Alternatively, the phallic member may be or appear flaccid. The fabric may be of the same type used for the pillow and may comprise any combination of cotton, polyester, silk, satin, or any other known material. Alternatively, the phallic member may be semi-rigid to rigid wherein it comprises plastic, rubber, latex or similar material known in the art. The phallic member may also be spring loaded such that it pops out of the pillow when dislodged from the cavity. The spring-loaded mechanism may comprise a thin strip of flexible metal or plastic, or it may comprise a conventional spring, such as a coil or biasing member with memory.

At least one surface of the pillow includes indicia for conveying a humorous message related to the appearance of the pillow and the phallic member. For instance, the indicia may include a drawing of at least the lower body of a man with the slit disposed in the vicinity of man's genitalia. The phallic member may include a ring and/or a bow tie, and the corresponding indicia may state something like "With This Ring I Thee Wed." In another embodiment, the pillow may comprise two phallic members, one being significantly larger than the other or one being flaccid compared to the other, and indicia comprising "Penis Envy." In another embodiment the phallic member may include a bow tie and the indicia may comprise a man in a tuxedo and the inscription, "Having A Coming Out Party." These are only examples of the indicia which may be employed. All copyrights and trademark rights in the indicia are reserved by the Applicant.

DETAILED DESCRIPTION OF THE INVENTION

Figure 15:
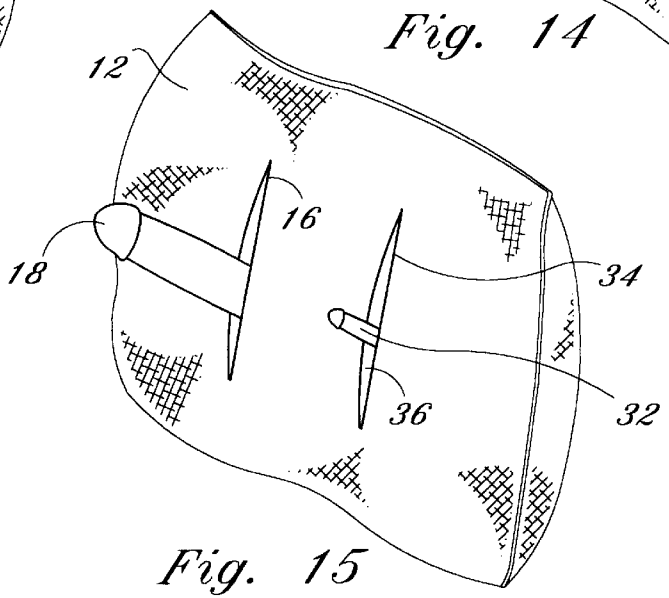
FIG. 15 is a front perspective view of the sixth alternative embodiment of the instant invention illustrating the slits in open positions with phallic members extending therethrough.
Figure 12:
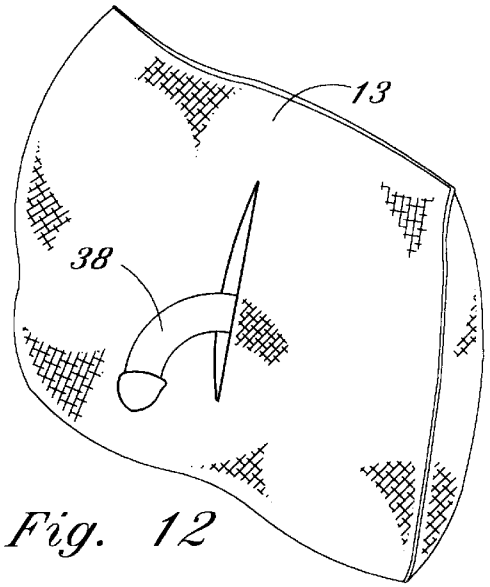
FIG. 12 is a front perspective view of a fifth alternative embodiment of the instant invention illustrating a second phallic member in a substantially downward extended position.
Figure 16:
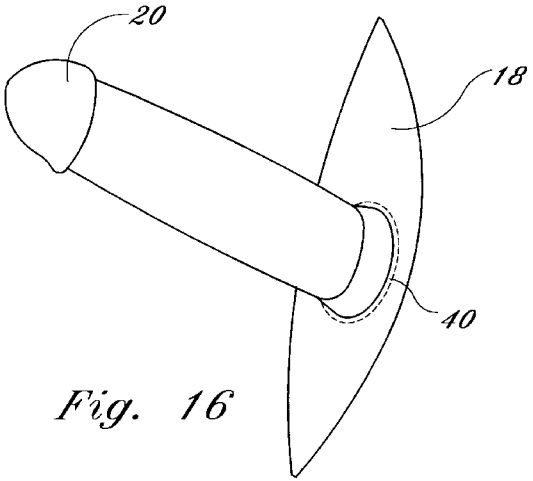
FIG. 16 is an enlarged view of the phallic member of the instant invention illustrating one method for attaching the phallic member to the pillow.

With reference to the drawings, FIGS. 1–17B depict the preferred embodiment and alternative embodiments of the novelty pillow of the instant invention which is generally characterized by the reference numeral 10. Referring to FIGS. 1–4, the preferred embodiment of the novelty pillow 10 comprises a conventional pillow base structure 11, a front surface 12, a rear surface 13, sides 14, a seam 15, at least one slit 16, indicia 17, a cavity 18 and at least one selectively extendable phallic member 20. The slit 16 is defined by the front surface (may alternatively be defined by the rear surface) and comprises an opening that provides access to the cavity 18. The cavity 18 provides a pocket for housing the phallic member 20 and a surface for affixing the phallic member 20. Alternatively, the phallic member 20 may be affixed to the front surface 12 (or rear surface 13). The cavity 18 comprises additional material that contains the stuffing within the pillow and provides a pocket of a predetermined volume for concealing the phallic member 20. The phallic member 20 is preferably stitched to the cavity material, as shown in FIG. 16. Alternatively, the phallic member 20 may be permanently affixed by adhesion, hardware, or other known devices in the art, or removably affixed by hook-and-loop (known by its trade name Velcro), snaps or other known devices in the art. The slit 16 is flexible and may be widened or opened for dislodging, removing and/or extending the phallic member 20 outside the pillow base 11. The novelty pillow 10 also comprises indicia 17 on the front surface 12 for conveying at least one predetermined humorous message. The rear surface 13 comprises the backside of the pillow base 11, which may be blank or have indicia 17, a slit 16 and/or phallic member 20. The rear surface 13 may be substantially planar or may be contoured, such as in the shape of buttocks for additional humorous value. The side surfaces 14 may also include indicia 17, a slit 16 and/or a phallic member 20 without departing from the scope and spirit of the invention.

Figure 5:
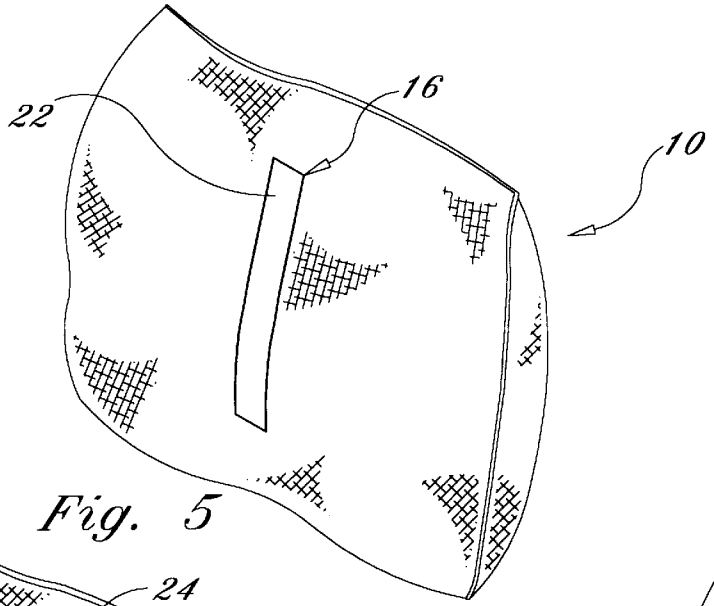
FIG. 5 is a front perspective view of an alternative embodiment of the instant invention illustrating the slit in a closed position and structure for completely closing the slit.
Figure 6:
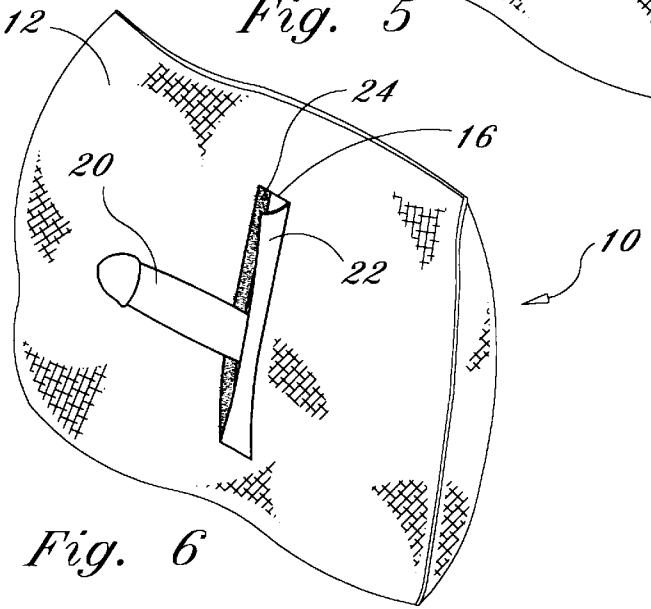
FIG. 6 is a front perspective view of an alternative embodiment of the instant invention illustrating the slit in an open position and the phallic member in an extended position.

The slit 16 may be made selectively accessible by various closure mechanisms. These various closure mechanisms described hereto may be employed regardless of where the slit 16 is defined or oriented. With reference to FIGS. 5 and 6, the slit 16 may include at least one hook-and-loop strip 22. The hook-and-loop strip 22 may comprise a pivotal extension of the front surface layer 12 or an additional structure sewn to the front surface 12. The strip 22 may comprise either the hook or loop portion of the hook-and-loop connecting mechanism. A corresponding closure strip 24 is disposed along an opposing edge of the slit 16. The corresponding strip 24 may be pivotal or stationary and may comprise an extension of the front surface layer 12 or a separate component sewn to the front surface 12. The corresponding strip 24 may comprise hooks or loops, so long as it engages and connects to the first strip 22.

Figure 3:
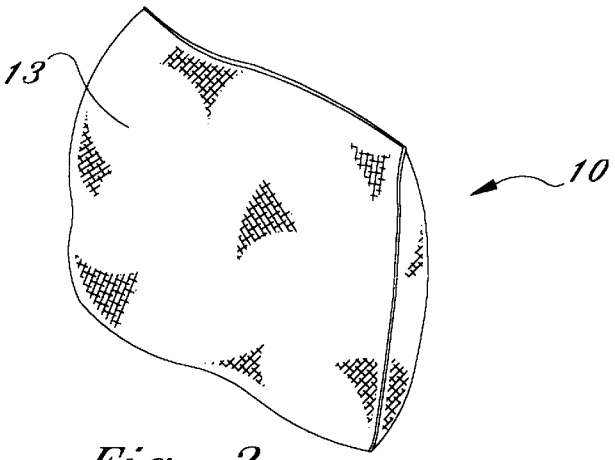
FIG. 3 is a rear perspective view of the preferred embodiment of the instant invention.
Figure 4:
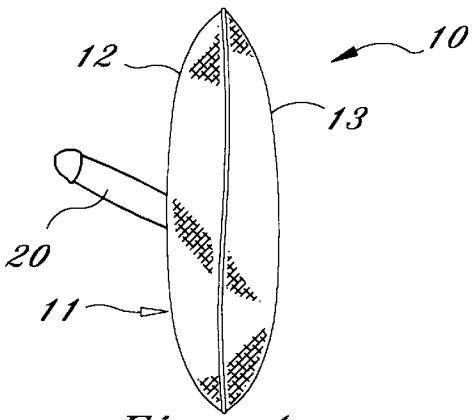
FIG. 4 is a side elevational view of the preferred embodiment of the instant invention illustrating the phallic member in an extended position.
Figure 1:
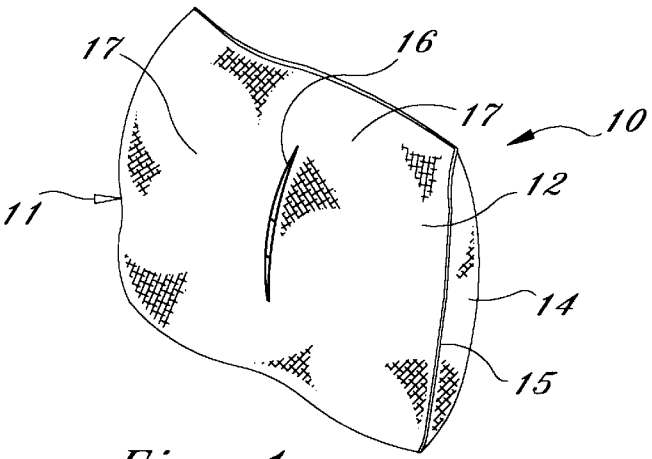
FIG. 1 is a front perspective view of the preferred embodiment of the instant invention illustrating the slit in the closed position.
Figure 2:
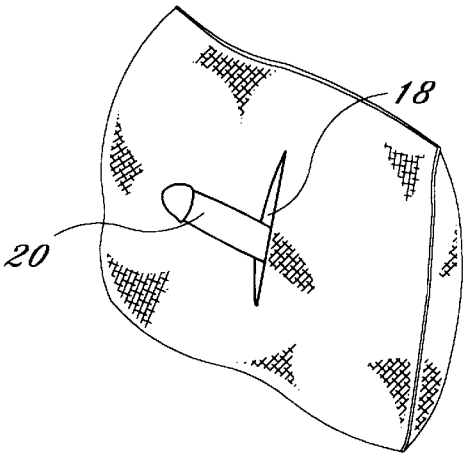
FIG. 2 is a front perspective view of the preferred embodiment of the instant invention illustrating the slit in the open position and the phallic member in an extended position.
Figure 7:
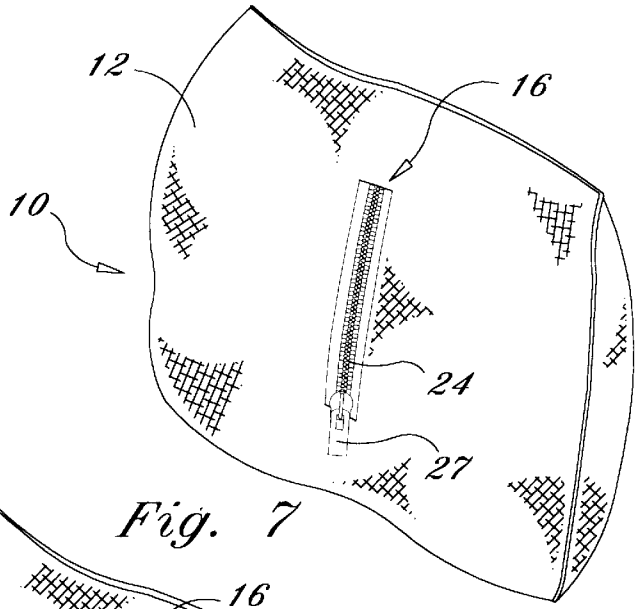
FIG. 7 is a front perspective view of a second alternative embodiment of the instant invention illustrating alternative structure for opening and closing the slit.
Figure 8:
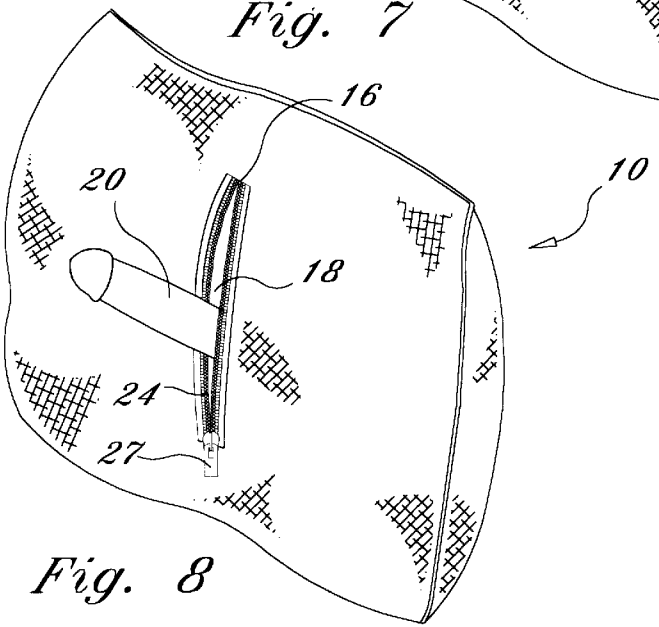
FIG. 8 is a front perspective view of a second alternative embodiment of the instant invention illustrating the slit in an open position and the phallic member in an extended position.

With reference to FIGS. 7 and 8, another embodiment of the closure mechanism may comprise a zipper 24. The zipper 24 is preferably stitched to the opening defined by the slit 16 and includes a conventional tab 27. The zipper 24 may be used with any embodiment. The zipper 24 may be coordinated with the indicia 17 for conveying a message. For instance, the zipper embodiment may include indicia comprising "Caught In the Act."

With reference to all the figures, the phallic member 20 preferably comprises a fabric material similar to that employed with the pillow base 11 on the front 12 and rear 13 surfaces. Alternatively, the phallic member 20 may comprise a different material. The phallic member 20 is preferably soft, pliable and flexible, albeit sufficiently rigid for standing erect when extending from the slit 16. However, the phallic member 20 may include an insert for making it stand erect. The phallic member 20 may comprise any combination of material, such as cotton, polyester, silk, satin or any other material known in the art. The phallic member 20 is preferably filled with a stuffing material similar to that used in stuffing the novelty pillow, and similar to that already employed in the art. The phallic member 20 should be flexible enough for fitting in the cavity 18 and for convenient removal therefrom. In an alternative embodiment, the phallic member 20 may be semi-rigid or rigid and may comprise materials such as latex, rubber, plastic or similar materials known in the art for achieving rigidity. This would allow the invention to augment those couples experiencing sexual disfunctions.

Figure 17B:
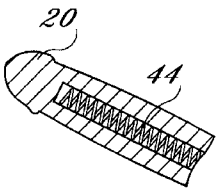
FIG. 17B is a side cut-away view of another embodiment of the phallic member illustrating another spring mechanism in phantom.
Figure 17A:
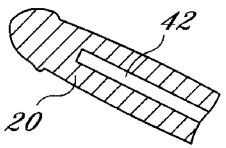
FIG. 17A is a side cut-away view of one embodiment of the phallic member illustrating the spring mechanism in phantom.

With reference to FIG. 16, the phallic member 20 is preferably permanently affixed to the pillow base 11 by stitching 40 and preferably within the cavity 18. The phallic member 20 may include a base extension to facilitate convenient stitching 40. With reference to FIGS. 17A and 17B, the phallic member may include a spring mechanism for semi-automatically or automatically extending away from the pillow base 11 when dislodged from the cavity 18. The spring may comprise a pliable piece of metal or plastic 42 having memory, as shown in FIG. 17A. The spring may also comprise a spring coil 44. Other conventional springs known in the art may be used without departing from the scope and spirit of the invention. The phallic member 20 may vary in size to correspond with the indicia 17.

Figure 11:
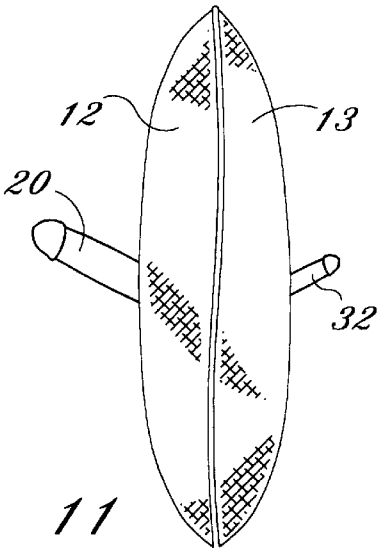
FIG. 11 is a side elevational view of the fourth alternative embodiment of the instant invention illustrating phallic members extending from opposite surfaces.
Figure 10:
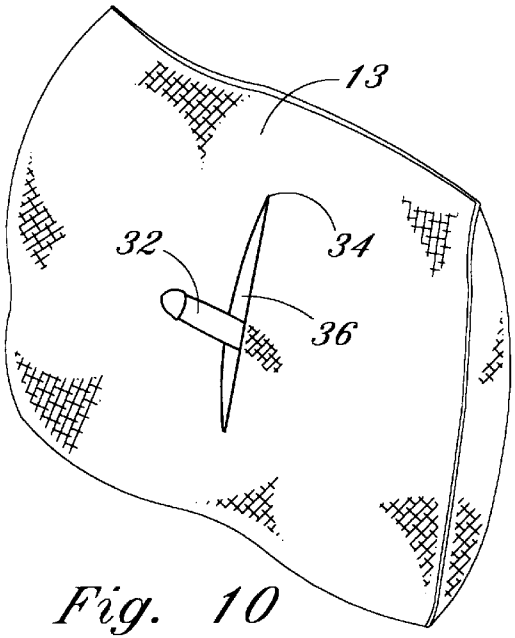
FIG. 10 is a rear perspective view of a fourth alternative embodiment of the instant invention illustrating a second slit opening and second phallic member in an extended position.
Figure 9:
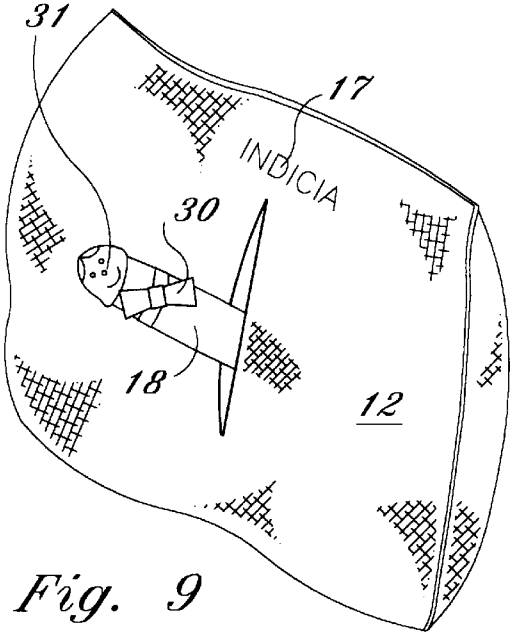
FIG. 9 is a front perspective view of third alternative embodiment of the instant invention illustrating the phallic member with a bow tie.
Figure 14:
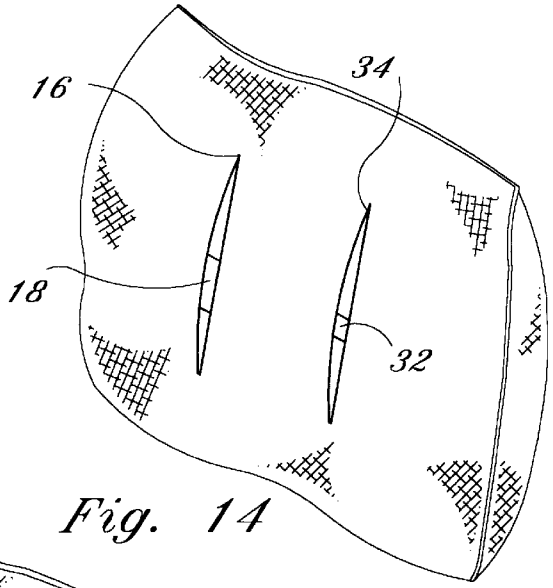
FIG. 14 is a front perspective view of a sixth alternative embodiment of the instant invention illustrating a plurality of slits on the same surface.
Figure 13:
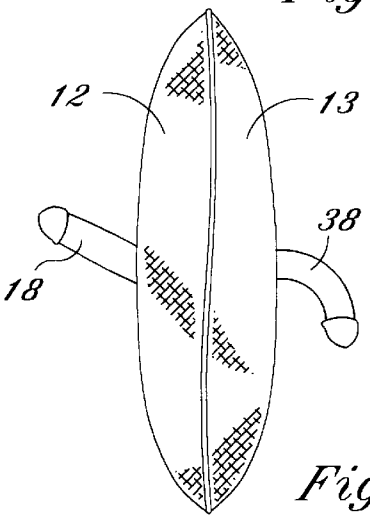
FIG. 13 is a side elevational view of the fifth alternative embodiment of the instant invention illustrating phallic members extending from opposite surfaces.

At least one phallic member 20 is employed with the instant invention. The number of phallic members 20 employed should correspond to the number of slits 16. The invention 10 may comprise a plurality of phallic members 20, as shown in FIGS. 11–15. With reference to FIGS. 11, 13 and 15, at least one phallic member 20 may be positioned on one surface with at least one smaller phallic member 32 or flaccid member 38 positioned on the same or opposite surface. The indicia 17 corresponding to the designs in these figures may comprise drawings of the lower body of a man and phrases such as "Penis Envy," "For Better or Worse" and/or "In Sickness And In Health." The applicant reserves all copyrights and/or trademark rights to the drawings and phrases disclosed herein. The phallic member 20 may also be fitted with a bow tie 30 and/or a smiling face 31 as shown in FIG. 9.

The indicia 17 of the instant invention may be inked, printed, stitched and/or embroidered on one or all surfaces. The indicium 17 corresponds to the phallic member 20 and slit 16 for conveying predetermined messages. The indicia 17 may also include bow ties, holiday themes such as Santa Clause, wedding bands and other desired forms.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A novelty pillow comprising:

a base structure having a front surface and a rear surface and an interior volume substantially filled with a filler;

at least one slit on at least on of said surfaces;

at least one flexible elongated member extending from said base through said slit, said member being substantially cylindrical in shape; and indicia disposed on at least one surface for conveying a predetermined humorous message corresponding to said member.

2. A novelty pillow as recited in claim 1, said pillow further comprising:

means, disposed on said base proximal to said slit, for opening and closing said slit.

3. A novelty pillow as recited in claim 2, wherein said opening and closing means comprises hook-and-loop disposed proximal said slit.

4. A novelty pillow as recited in claim 2, wherein said opening and closing means comprises a zipper disposed along said slit.

5. A novelty pillow as recited in claim 1, said base structure further comprises:

a cavity defined within said base structure directly below said slit for isolating said slit from said filler.

6. A novelty pillow as recited in claim 5, wherein said member is secured to said base structure within said cavity.

7. A novelty pillow as recited in claim 1, wherein said member further comprises a spring mechanism.

8. A novelty pillow comprising:

a base structure having a front surface and a rear surface and an interior volume substantially filled with a filler;

at least one slit on at least on of said surfaces;

a cavity defined within said base structure directly below said slit for isolating said slit from said filler;

at least one flexible elongated member extending from said cavity through said slit, said member being substantially cylindrical in shape; and indicia disposed on at least one surface for conveying a predetermined humorous message corresponding to said member.

9. A novelty pillow as recited in claim 8, wherein said member further comprises a spring mechanism.

10. A novelty pillow as recited in claim 8, said pillow further comprising means, disposed on said base proximal to said slit, for opening and closing said slit.

11. A novelty pillow as recited in claim 10, wherein said opening and closing means comprises hook-and-loop disposed proximal said slit.

12. A novelty pillow as recited in claim 10, wherein said opening and closing means comprises a zipper disposed along said slit.

* * * * *